US011427985B2

(12) United States Patent
Bernasinski et al.

(10) Patent No.: US 11,427,985 B2
(45) Date of Patent: Aug. 30, 2022

(54) BORING MACHINE PROVIDED WITH FOUR BORING BODIES

(71) Applicant: SOLETANCHE FREYSSINET, Rueil Malmaison (FR)

(72) Inventors: Régis Bernasinski, Rueil Malmaison (FR); Pascal Rodriguez, Rueil Malmaison (FR); Michel Coudry, Rueil Malmaison (FR); Bertrand Steff De Verninac, Rueil Malmaison (FR)

( * ) Notice: Subject to any disclaimer, the term of this patent is extended or adjusted under 35 U.S.C. 154(b) by 563 days.

(21) Appl. No.: 16/467,536

(22) PCT Filed: Dec. 13, 2017

(86) PCT No.: PCT/FR2017/053532
§ 371 (c)(1),
(2) Date: Jun. 7, 2019

(87) PCT Pub. No.: WO2018/109370
PCT Pub. Date: Jun. 21, 2018

(65) Prior Publication Data

US 2019/0323205 A1 Oct. 24, 2019

(30) Foreign Application Priority Data

Dec. 14, 2016 (FR) ..... 16 62446

(51) Int. Cl.

| | |
|---|---|
| ***E02F 5/08*** | (2006.01) |
| ***E02F 5/14*** | (2006.01) |
| ***E02F 9/22*** | (2006.01) |
| ***E02D 17/13*** | (2006.01) |
| *E02D 5/00* | (2006.01) |

(52) U.S. Cl.
CPC ..... *E02F 5/08* (2013.01); *E02D 17/13* (2013.01); *E02F 5/145* (2013.01); *E02F 9/2292* (2013.01); *E02D 5/00* (2013.01)

(58) Field of Classification Search
CPC ..... E02F 5/02; E02F 5/08; E02F 5/145; E02F 9/2292; E02D 17/13; E02D 5/00
USPC ..... 37/94
See application file for complete search history.

(56) References Cited

U.S. PATENT DOCUMENTS

| | | | |
|---|---|---|---|
| 4,718,504 | A | 1/1988 | Terashima et al. |
| 2009/0165338 | A1 | 7/2009 | Chagnot |

FOREIGN PATENT DOCUMENTS

| | | | |
|---|---|---|---|
| CN | 201428133 | Y | 3/2010 |
| EP | 2514911 | B1 | 6/2013 |
| JP | H02 190516 | A | 7/1990 |
| JP | H10331187 | A | 12/1998 |
| JP | 2003171952 | A | 6/2003 |
| WO | 2012/167170 | A2 | 12/2012 |

*Primary Examiner* — Tara Mayo-Pinnock
(74) *Attorney, Agent, or Firm* — Robert Facey; Adam Lewental

(57) ABSTRACT

The invention provides a boring machine (10) for making a trench (T) in soil (S), the machine comprising a frame (12) that extends along a longitudinal direction (A), said frame (12) carrying a boring device (20) provided with four rotary boring members driven by four motors about axes of rotation that are stationary relative to one another.

26 Claims, 7 Drawing Sheets

BORING MACHINE PROVIDED WITH FOUR BORING BODIES

BACKGROUND

The present disclosure relates to the field of making trenches in the ground, in particular for fabricating diaphragm walls for support or for forming sealing screens, for fabricating piles or "barrettes", or indeed for fabricating trenches by a technique of in situ mixing of the soil being excavated with a fluid, and known as "soil mixing".

More precisely, the disclosure relates to a boring machine for making wall elements of great thickness.

Existing tools generally comprise a pair of cutter members in which each cutter member comprises a pair of drums driven in rotation by a hydraulic motor housed in each of the two drums. The drums are cantilever-mounted on a support situated at the bottom end of a frame.

In order to make trenches of great thickness, it is known to make use of drums that present axial lengths that are considerable, of the order of 500 millimeters (mm) to 1000 mm. It can be understood that thickness is taken into consideration along the axial direction of the drums.

Nevertheless, such a configuration runs risks of breakage because drums of great axial length are cantilevered out with a large overhang.

Furthermore, the drums and the motor are generally carried by a central panel. When the drums present long axial lengths, it is necessary to provide a central panel of great thickness. A drawback is that the zone situated under the central panel cannot be excavated, thereby causing a large step to appear that takes time to destroy and requires additional tools.

It is also known that the greater the axial length of the drums, the more difficult it becomes to control the boring path, which constitutes another drawback of the known configuration.

SUMMARY

The present disclosure proposes a boring machine that is capable of making holes of great thickness and remedying the above-mentioned drawbacks.

To do this, the disclosure provides a boring machine for making a trench in soil, the machine comprising a frame extending along a longitudinal direction, said frame having a bottom end, the machine having a boring device mounted at the bottom end of the frame, the boring device comprising:

a first boring member that is rotatable about a first axis of rotation, the first axis of rotation being transverse to the longitudinal direction of the frame;

a first motor configured to drive rotation of the first boring member about the first axis of rotation;

a second boring member rotatable about a second axis of rotation, the second axis of rotation being stationary relative to the first axis of rotation;

a second motor configured to drive rotation of the second boring member in rotation about the second axis of rotation;

a third boring member rotatable about a third axis of rotation, the third axis of rotation being spaced apart from and parallel to the first axis of rotation;

a third motor configured to drive the third boring member in rotation about the third axis of rotation;

a fourth boring member that is rotatable about a fourth axis of rotation, the fourth axis of rotation being stationary relative of the first, second, and third axes of rotation, the first and third axes of rotation lying in a first plane that is stationary relative to a second plane containing the second and fourth axes of rotation; and a fourth motor configured to drive the fourth boring member in rotation about the fourth axis of rotation.

The machine of the disclosure is thus fitted with at least four cutter members and four motors, thereby reducing the forces to which the shafts driving the drums are subjected and reducing the overhang.

This configuration also makes it possible to reduce the thickness of the central panels carrying the pairs of motors, thereby having the effect of creating two small ridges that are easier to break and remove than the single large ridge that appears when using the prior art machine.

Advantageously, the second boring member is suitable for rotating relative to the first boring member. It can be understood that the second boring member can rotate in the same direction as the first boring member, or in the opposite direction.

Furthermore, the fourth boring member is advantageously suitable for rotating relative to the third boring member. It can be understood that the third boring member can rotate in the same direction as the fourth boring member, or in the opposite direction.

This reversal of the direction of rotation between the first and second motors (or the third and fourth motors, as the case may be) serve in particular to facilitate boring in ground that is very hard.

Furthermore, the presence of four motors that can be controlled in independent manner makes it easier to control the boring path.

By acting on the speed of rotation of each of the motors, the operator can cause the machine to turn in a horizontal plane in order to correct twisting, if any.

In an advantageous embodiment, the boring device includes a support that is mounted at the bottom end of the frame and that carries the first, second, third, and fourth boring members, together with the first, second, third, and fourth motors.

In a variant, the support is removably mounted to the frame.

Preferably, but not necessarily, each boring member is rotatably mounted on a panel that is itself mounted to a support device connected to the frame. The panel may be mounted to the support in detachable manner, e.g. by means of a lateral dovetail coupling system.

In preferred manner, the support comprises a plate to which the first, second, third, and fourth boring members and the first, second, third, and fourth motors are mounted.

In a preferred embodiment, the plate carries the panels to which the boring members are rotatably mounted. Advantageously, the assembly constituted by the support and the first, second, third, and fourth boring members is hinged relative to the bottom end of the frame. This hinge enables the boring device to be steered, thereby making it easy to correct the boring path.

Preferably, the first, second, third, and fourth axes of rotation lie substantially in a common plane that is transverse to the longitudinal direction of the frame.

Advantageously, the first, second, third, and fourth motors are housed respectively in the first, second, third, and fourth boring members.

In a preferred embodiment, the first, second, third, and fourth boring members comprise respectively first, second, third, and fourth pairs of drums, the first, second, third, and fourth pairs of drums being provided respectively with first, second, third, and fourth series of cutter teeth.

Advantageously, the first and second axes of rotation are colinear, and the third and fourth axes of rotation are colinear.

In another advantageous embodiment, the diameter of the second and fourth boring members is greater than the diameter of the first and third boring members.

This particular arrangement makes it possible to bore a trench of horizontal section that is substantially trapezoidal in shape. An advantage is to make it easy to make a curvilinear wall, in particular a circular wall, e.g. a circular diaphragm wall, made up of a succession of trapezoidal panels.

Preferably, the distance between the second and fourth axes of rotation is greater than the distance between the first and third axes of rotation. An advantage is to make it easier to position the second and fourth boring members of diameters that are greater than the first and third boring members.

Also preferably, the radial heights of the teeth of the second and fourth series of teeth are greater than the radial heights of the teeth of the first and third series of teeth.

An advantage is to refine the trapezoidal shape of the horizontal section of the trench, thereby having the effect of improving the circular shape of the wall.

By way of non-limiting example, the machine of the disclosure can be used to make two primary holes that are spaced from each other in order to make two trapezoidal primary panels, prior to making a secondary hole between the two primary panels so as to make a secondary panel joining the two primary panels together, and so on until the circular wall is obtained.

Advantageously, the first boring member comprises first and second drums, while the second boring member comprises third and fourth drums, and the minimum distance between the second and third drums considered in a direction parallel to the first axis of rotation is less than 5 centimeters (cm).

This small distance between the second and third drums serves to avoid a large ridge appearing between the first and second boring members.

According to another advantageous aspect, the machine further comprises a control member for controlling the first, second, third, and fourth motors independently of one another.

The disclosure thus makes it possible to control the first, second, third, and fourth boring members independently of one another. An advantage is to enable the operation of the machine to be adapted to the configuration of the soil situated under the cutting front constituted by the four boring members. Specifically, it can be understood that soil is generally not uniform across the entire area of the cutting front, given the large area of the cutting front of the machine of the disclosure. The disclosure makes it possible to adapt to potential non-uniformity of the soil under the cutting front by controlling each of the boring members in separate manner.

Another advantage is to be able to modify the position of the boring device and of the frame in the trench that is being bored, thereby making it possible to correct potential deflection of the boring path.

Yet another advantage is to distribute the cutting effect over the boring device.

Preferably, the control member is configured to control the speeds of rotation and/or the directions of rotation of the first, second, third, and fourth motors independently of one another.

Thus, multiple operating combinations are made possible. It is thus possible to move the boring device in translation in a horizontal plane, or indeed to make it pivot in one direction or the other about a vertical axis.

Advantageously, the first, second, third, and fourth motors are hydraulic, and the control member is configured to adjust the hydraulic power delivered to each of the first, second, third, and fourth motors.

Also advantageously, the boring machine of the disclosure further comprises at least a first hydraulic circuit, the first hydraulic circuit comprising:

a first main hydraulic pump; and a first distribution member connected to the first main hydraulic pump, the first distribution member powering a first group of two motors selected from the first, second, third, and fourth motors.

In preferred manner, the boring device includes the first distribution member. In a variant, the first distribution member may be arranged in the frame.

It can thus be understood that the first distribution member is preferably designed to be situated at the bottom end of the frame, close to the boring members.

An advantage is to avoid increasing the number of hydraulic hoses, and thus be able to mount the boring device of the disclosure on a conventional frame that was initially designed for two boring members.

Another advantage is that controlling flow rate close to the motors is more responsive, in particular since there are no harmful effects from deformation of hydraulic hoses under pressure, or from head losses upstream.

In a first embodiment, the first distribution member comprises:

a first main hydraulic motor powered by the first main hydraulic pump;

a first secondary hydraulic pump actuated by said first main hydraulic motor, the first secondary hydraulic pump powering one of the two motors of the first group; and a second secondary hydraulic pump actuated by said first main hydraulic motor, the second secondary hydraulic pump powering the other one of the two motors of the first group.

In a second embodiment, the first distribution member comprises a first hydraulic junction connected to the first main hydraulic pump and to at least one of the motors of the first group, and a second hydraulic junction connected to the first main hydraulic pump and to at least the other one of the motors of the first group.

Advantageously, the boring machine of the disclosure also includes a second hydraulic circuit connected to the control member, the second hydraulic circuit being distinct from the first hydraulic circuit and comprising:

a second main hydraulic pump; and a second distribution member connected to the second main hydraulic pump, the second distribution member powering a second group of two motors taken from among the first, second, third, and fourth motors, the second group being different from the first group.

In preferred manner, the boring device includes the second distribution member. In a variant, the second distribution member may be arranged in the frame.

In a first embodiment, said boring machine is a cutter, and the first, second, third, and fourth boring members comprise cutter tools.

In a second embodiment, said machine is a boring and mixing machine and the first, second, third, and fourth boring members comprise mixing tools.

Preferably, in the second embodiment, the frame is constituted by a longitudinal bar, and said machine further comprises a mast and a carriage that is movable along the mast, the carriage being fastened to the longitudinal bar.

Thus, the boring machine of the disclosure can advantageously be used for performing a method of mixing excavated soil in situ with a binder, which method is known as the "soil-mixing" method.

The disclosure also provides a method of making a diaphragm wall in soil by using a boring machine of the disclosure.

Finally, the disclosure provides a method of making a circular diaphragm wall by using a boring machine of the disclosure. For this purpose, use is made of the above-described boring device variant in which the diameter of the second and fourth boring members is greater than the diameter of the first and third boring members.

BRIEF DESCRIPTION OF THE DRAWINGS

The disclosure can be better understood on reading the following description of embodiments of the disclosure given as non-limiting examples and with reference to the accompanying drawings, in which.

DETAILED DESCRIPTION

With reference to FIGS. 1 to 4, there follows a description of a first embodiment of a boring machine 10, specifically a cutter, for making a trench T in soil S. The boring machine 10 comprises a frame 12 that extends in a longitudinal direction A. In this example, the longitudinal direction A is a vertical direction. The frame 12 presents a bottom end 12*a* and a top end 12*b* that is connected to a pair of support cables 14. In known manner, the support cables are suspended from the top end of a mast of a carrier (not shown).

The boring machine 10 of the disclosure also has a boring device 20 that is mounted at the bottom end 12*a* of the frame 12.

Figure 1:
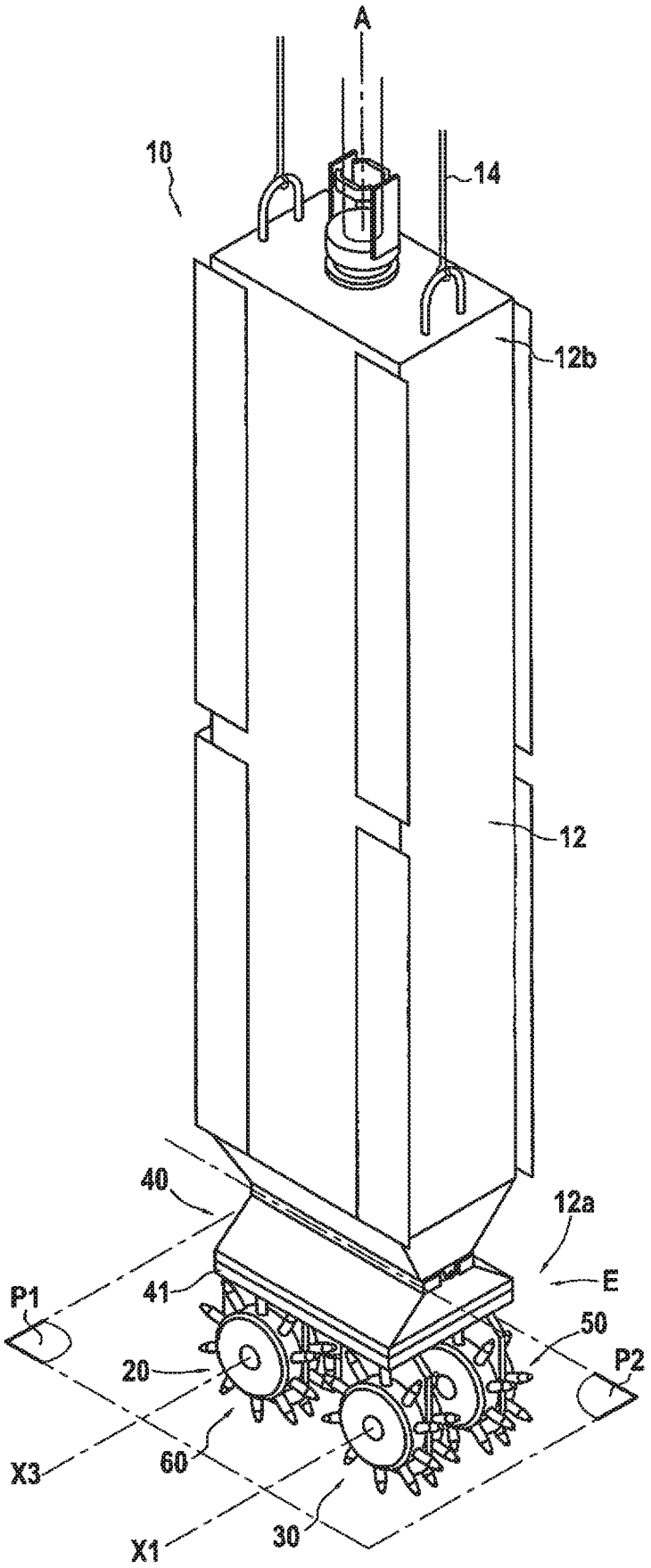
FIG. 1 is a perspective view of an embodiment of a boring machine of the disclosure, fitted with a boring device in a first embodiment.

In the example of FIG. 1, the boring device 20 is mounted at the bottom end 12*a* of the frame 12 in removable manner. The removable mounting system is described in greater detail below.

Nevertheless, without going beyond the ambit of the present disclosure, the boring device could be made integrally with the frame 12.

In accordance with the disclosure, the boring machine 10 has four rotary boring members.

More precisely, the boring device has a first boring member 30 that is rotatable about a first axis of rotation X1. As can be seen from FIGS. 1 to 3, the first axis of rotation X1 is transverse to the longitudinal direction A of the frame 12.

The boring device 20 also has a first motor 32 that is configured to drive rotation of the first boring member 30 about the first axis of rotation X1. In the example shown, the first motor 32 is housed in the first boring member 30. In this example, the motor 32 is a hydraulic motor powered by a hydraulic circuit that is described in greater detail below.

In this embodiment, the first boring member has a first pair of drums comprising a first drum 34*a* and a second drum 34*b* that are provided with first series of cutter teeth 36. It can be seen in the example of FIGS. 1 to 3 that the cutter teeth 36 of the first series present the same radial height.

The boring device 20 also has a support 40 that, in this non-limiting example, presents the shape of a plate 41. The first boring member 20 is carried by the support, and more precisely in this example by the plate 41. More precisely, the first and second drums 34*a* and 34*b*, and also the motor 32 are held by a first panel 38 mounted under the plate 41 of the support and extending transversely relative to the first axis of rotation X1.

The boring device 20 also has a second boring member 50 that is rotatable about a second axis of rotation X2, the second axis of rotation X2 being stationary relative to the first axis of rotation X1. In this embodiment, the first and second axes of rotation X1 and X2 are colinear.

In addition, the second boring member 50 is suitable for rotating relative to the first boring member 30. Consequently, the first and second boring members 30 and 50 may rotate in the same direction, in opposite directions, and at speeds that are identical or different.

The second boring member has a second pair of drums 52 comprising third and fourth drums 54*a* and 54*b*.

The third and fourth drums 54*a* and 54*b* are fitted with second series of cutter teeth 56. In this example, the cutter teeth 56 of the second series present the same radial height as the cutter teeth 36 of the first series.

The second boring member 50 also has a second motor 52 configured to drive the second boring member 50 in rotation about the second axis of rotation X2.

Like the first boring member 30, the second motor 52 is likewise housed in the second boring member 50. The second motor 52 is a hydraulic motor that is powered by a hydraulic circuit, which is described in greater detail below.

Just like the first boring member 20, the second boring member is carried by the support 40, and more precisely by the plate 41 in this example.

The second motor 52, together with the third and fourth drums 54*a* and 54*b* are held by a second panel 58 mounted under the support 40 and extending transversely relative to the second axis of rotation X2. It can also be understood that the first and second panels 38 and 58 are stationary relative to each other.

Figure 2:
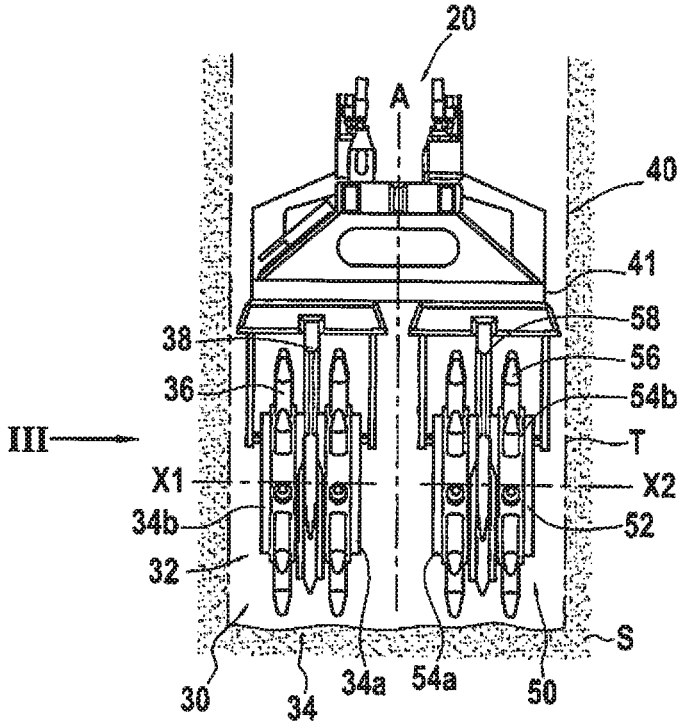
FIG. 2 shows the boring device of the FIG. 1 machine in side view.
Figure 3:
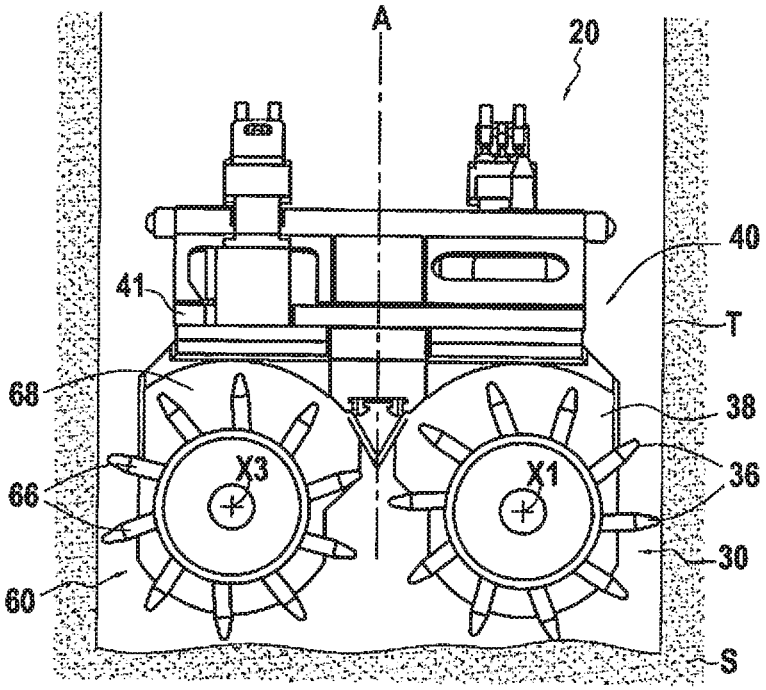
FIG. 3 shows the boring device of the FIG. 1 machine in face view.
Figure 4:
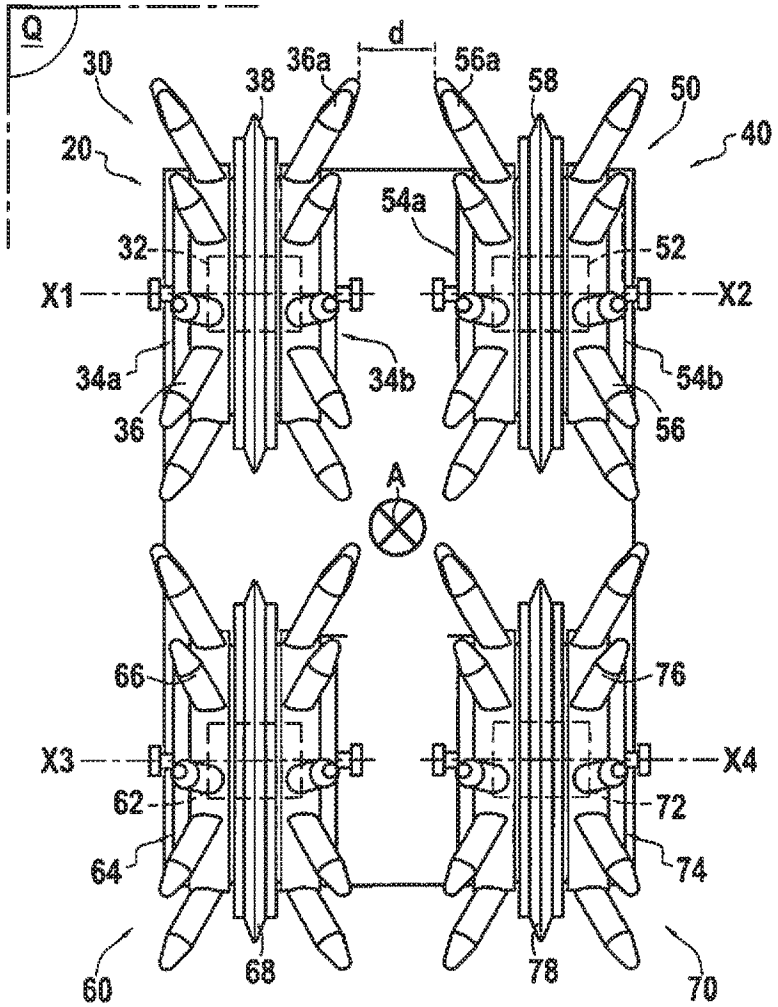
FIG. 4 shows the boring device of the FIG. 1 machine seen from below.

In the example of FIG. 4, which shows the FIG. 2 boring device 20 seen from below, the minimum distance d between the second and third drums 34*b* and 54*a* when considered in a direction parallel to the first axis of rotation X1 is less than 5 cm. This minimum distance d is measured between the sloping cutter teeth 36*a* and 56*a* of the first and second series of teeth.

The boring device also has a third boring member 60 that is rotatable about a third axis X3, that is spaced apart from and parallel to the first axis of rotation X1, as shown in FIG. 4. It can be understood that the first and third axes of rotation X1 and X3 lie in a first plane P1 that is orthogonal to the longitudinal direction A of the frame 12.

The third boring member 60 is suitable for rotating relative to the first and second boring members 30 and 50, in the same direction or in opposite directions.

For this purpose, the third boring member 60 is driven in rotation about the third axis of rotation X3 by a third motor 62. This third motor 62 is housed in the third boring member 60 and serves to drive the third pair of drums 64 in rotation. The third pair of drums 64 is likewise mounted under the plate 41 of the support 40 by means of a third panel 68 similar to the first panel.

The drums of the third pair 64 are fitted with a third series of cutter teeth 66 that, in this example, present the same radial height as the cutter teeth of the first and second series.

The boring device also has a fourth boring member 70 that is rotatable about a fourth axis of rotation X4. The third and fourth axes of rotation X3 and X4 are colinear. The fourth axis of rotation X4 is stationary relative to the first, second, and third axes of rotation X1, X2, and X3. Furthermore, the second and fourth axes of rotation X2 and X4 lie in a second plane P2 that is orthogonal to the longitudinal direction A of the frame, which in this example is vertical. In the example of FIGS. 1 and 4, the first and third planes P1 and P2 are coplanar. Still in this example, the first, second, third, and fourth axes of rotation X1, X2, X3, and X4 lie in a common plane Q.

The fourth boring member 70 is suitable for rotating relative to the first, second, and third boring members.

The boring device 20 also has a fourth motor 72 configured to drive the fourth boring member 70 in rotation about the fourth axis of rotation. This fourth motor 72 is housed in the fourth boring member, and it is powered by the hydraulic circuit as described below. The fourth boring member 70 has a fourth pair of drums 74 that are fitted with a fourth series of cutter teeth 76. In this example, the radial height of the cutter teeth in the fourth series is equal to the radial height of the teeth in the first, second, and third series.

The fourth boring member 70 is also carried by the support 40, and more precisely, in this example, by the plate 41. More precisely, the fourth pair of drums and the fourth motor 72 are held by a fourth panel 78 mounted under the plate 41 of the support and extending transversely relative to the fourth axis of rotation X4.

It can thus be understood that the support 40, mounted at the bottom end 12*a* of the frame 12, carries the first, second, third, and fourth boring members 30, 50, 60, and 70, together with the first, second, third, and fourth motors 32, 52, 62, and 72.

Furthermore, the first, second, third, and fourth boring members 30, 50, 60, and 70, and also the first, second, third, and fourth motors 32, 52, 62, and 72 are mounted under the plate 41.

The first, second, third, and fourth boring members 30, 50, 60, and 70 are preferably mounted under the plate 41 in removable manner. For this purpose, the support 40 of the boring device has a dovetail type system (not shown) enabling the boring members to be mounted laterally, i.e. in a direction parallel to the first axis of rotation X1.

Figure 5:
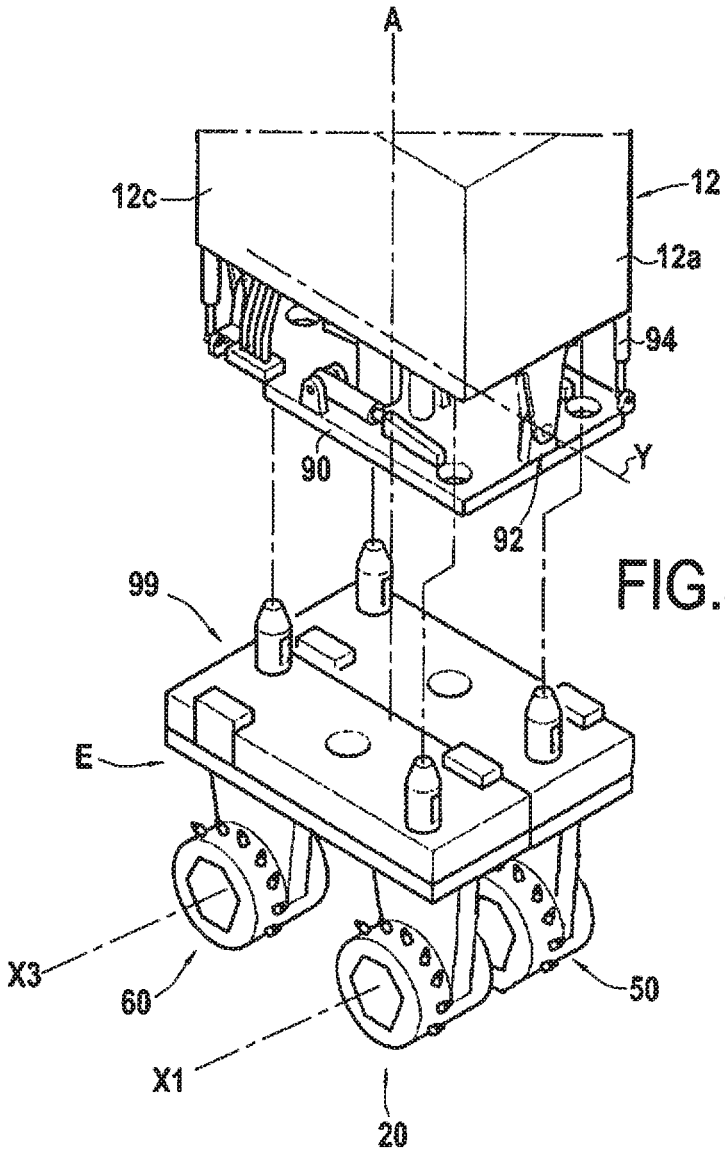
FIG. 5 shows a variant of the FIG. 1 boring machine in which the boring device is mounted removably and pivotally relative to the frame.

The assembly E constituted by the support 40 and the first, second, third, and fourth boring members 30, 50, 60, and 70 is also hinged relative to the bottom end 12*a* of the frame. For this purpose, and as shown in FIG. 5, the frame has at its bottom end 12*a*, a fastener slab 90 that is connected to the body 12*c* of the frame via a hinge 92 mounted to pivot about a pivot axis Y that is orthogonal to the longitudinal direction A and to the first axis of rotation X1. In this example, pivoting is performed by means of an actuator 94 arranged between the body 12*c* of the frame and the fastener slab 90.

It can also be seen in FIG. 5 that the boring machine has releasable securing means 99 for enabling the boring device 20 to be releasably mounted to the fastener slab 90.

By way of example, the releasable securing means 99 may be those described in FR 2 856 088.

Figure 6:
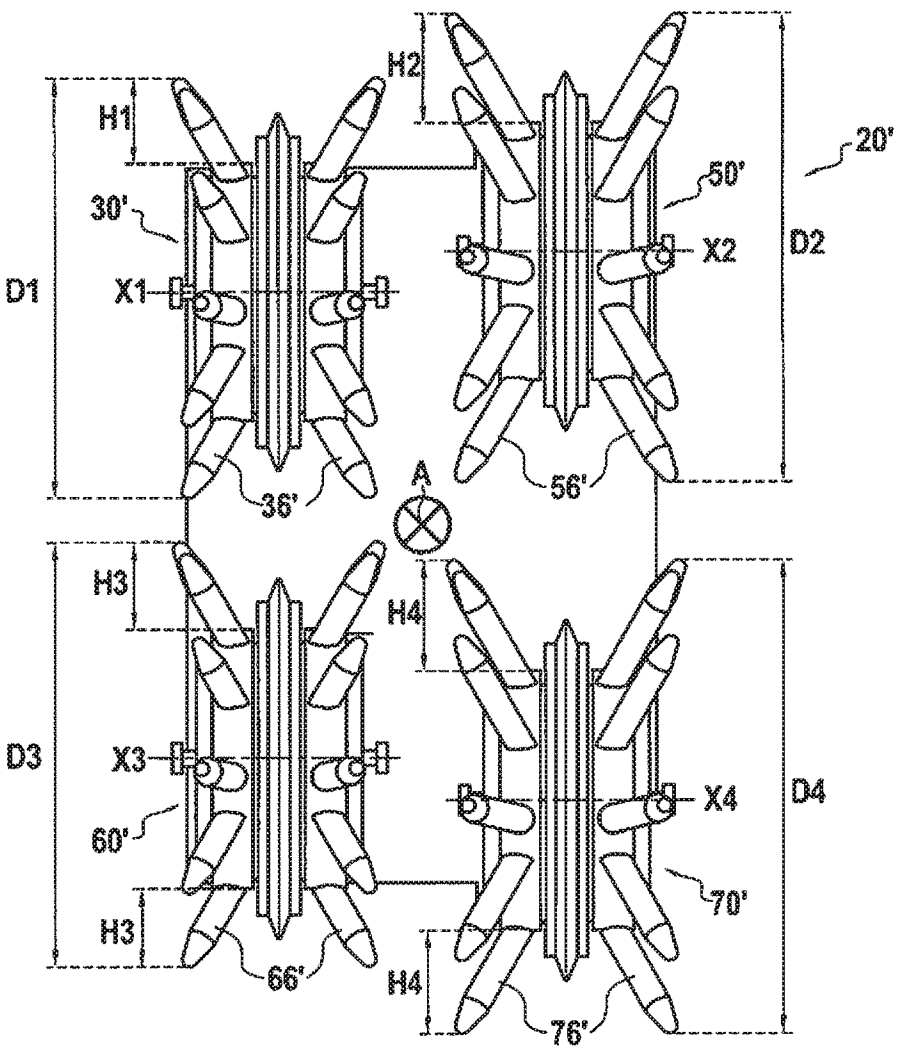
FIG. 6 shows a variant of the FIG. 4 boring device, in which the diameters of the second and fourth boring members are greater than the diameters of the first and third boring members.

FIG. 6 shows another embodiment of the boring device 20' of the disclosure that serves to make trenches of substantially trapezoidal shape, or at least of a shape that is not rectangular.

The boring device 20' shown in FIG. 6 differs from the boring device 20 of FIG. 4 by the fact that the diameters D2 and D4 of the second and fourth boring members 50 and 70 are greater than the diameters D1 and D3 of the first and third boring members 30 and 70.

This difference in diameter is obtained by the radial height H2 and H4 of the teeth of the second and fourth series of teeth 56' and 76' being greater than the radial heights H1 and H3 of the first and third series of teeth 36' and 66'. In other words, in this example, the diameters of the drums of the four boring members are identical, but the radial heights of the cutter teeth of the second and fourth boring members are greater than the radial heights of the first and third boring members. In a variant that is not shown, the diameters of the drums of the second and fourth boring members could be different from those of the drums of the first and third boring members.

In this example, it can also be seen that the first and second axes of rotation X1 and X2 are not colinear. Likewise, the third and fourth axes of rotation X3 and X4 are not colinear.

Figure 7:
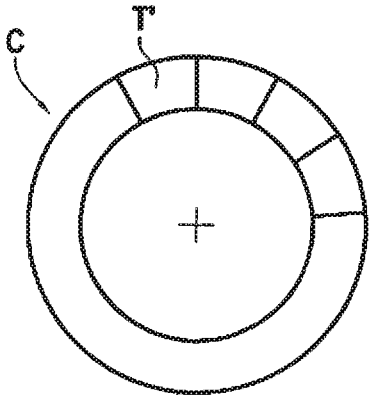
FIG. 7 is a diagram showing a circular diaphragm wall made with the boring machine fitted with the FIG. 6 boring device.
Figure 8:
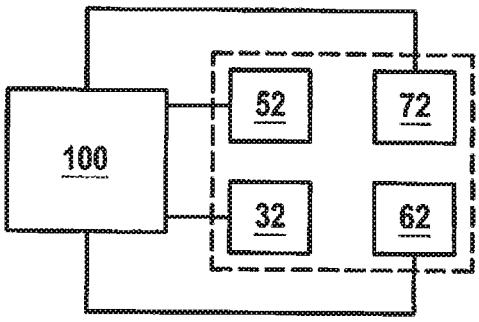
FIG. 8 is a diagram of a control member for controlling the boring device.

The advantageous configuration of the boring device 20' enables a trench T' to be made of a shape that is substantially trapezoidal, as shown in FIG. 7. Juxtaposing trenches T' makes it easy to provide a wall that is continuous, e.g. a diaphragm wall C having a shape that is substantially circular or annular.

The boring machine 10 also has a control member 100 for controlling the first, second, third, and fourth motors 32, 52, 62, and 72 independently of one another. In particular, the control member 100 is configured to control the speeds of rotation and/or the directions of rotation of the first, second, third, and fourth motors 32, 52, 62, and 72 independently of one another.

To do this, the control member 100 is configured to adjust the hydraulic power delivered to each of the first, second, third, and fourth hydraulic motors 32, 52, 62, and 72.

The control member 100 comprises at least a first hydraulic circuit 110 that comprises:

a first main hydrauluic pump 112; and a first distribution member 114 that feeds a first group of motors, which is constituted in this example by the first and second hydraulic motors 32 and 52.

Figure 9:
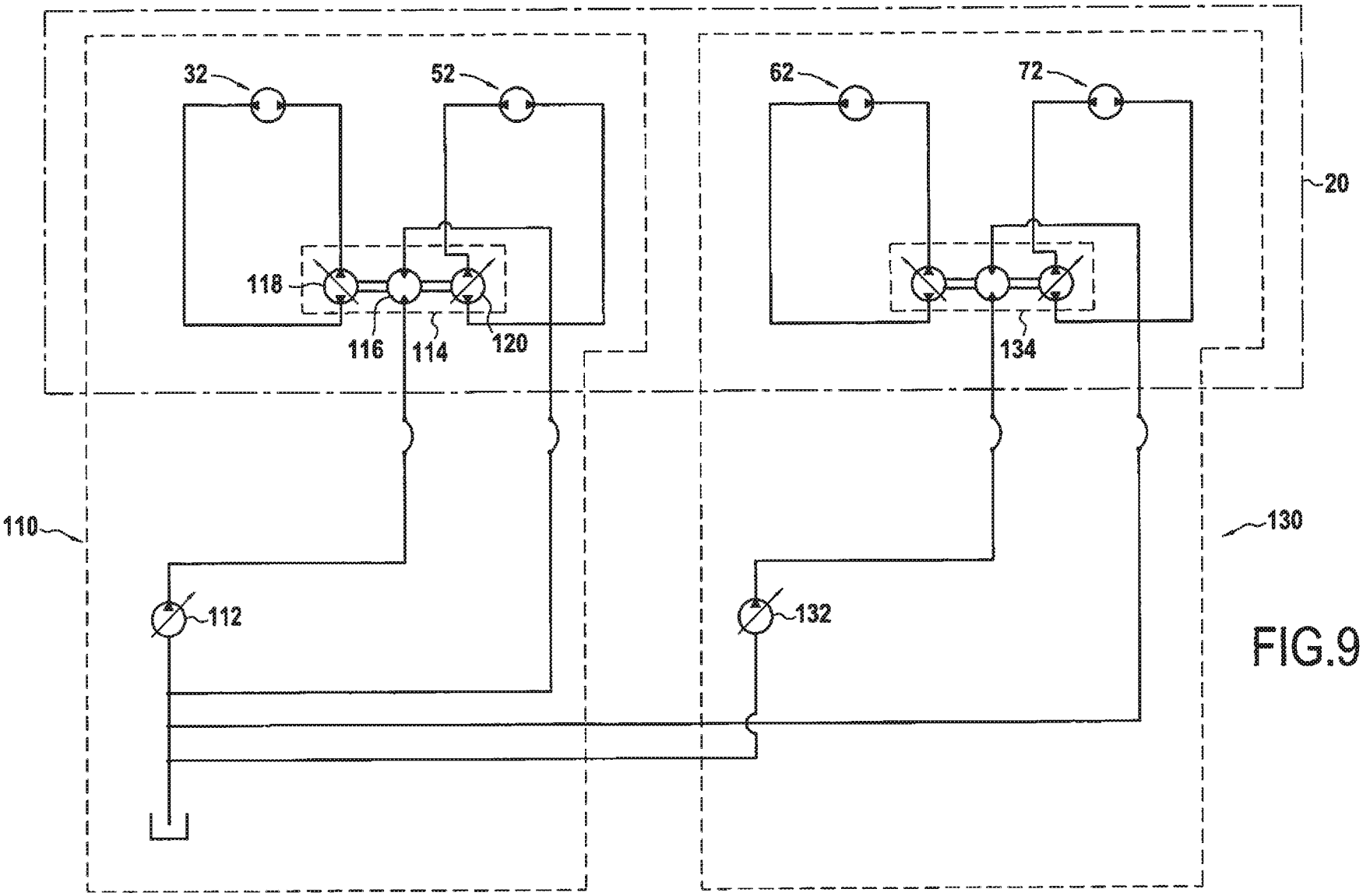
FIG. 9 shows a first embodiment of a hydraulic circuit for controlling the boring device of the FIG. 1 machine.

As can be understood from FIG. 9, the boring device 20 includes the first distribution member 114.

In other words, the boring device includes not only the first and second hydraulic motors 32 and 52, but also the first distribution member 114.

The first distribution member 114 comprises:

a first main hydraulic motor 116 that is powered by the first main hydraulic pump 112;

a first secondary hydraulic pump 118 that is actuated by the first main hydraulic motor 116, the first secondary hydraulic pump 118 powering the first hydraulic motor 32; and a second secondary hydraulic pump 120, actuated by the first main hydraulic motor 116, the second secondary hydraulic pump 120 powering the second hydraulic motor 52.

The boring machine also has a second hydraulic circuit 130 that comprises:

a second main hydraulic pump 132; and a second distribution member 134 that is connected to the second main hydraulic pump 132, the second distribution member 134 powering a second group of motors constituted by the third and fourth hydraulic motors 62 and 72.

Once more, the boring device 20 includes both the third and fourth hydraulic motors 62 and 72 and also the second distribution member 134.

It can thus be understood that the first and second hydraulic circuits 110 and 130 constitute two separate hydraulic circuits for powering the motors of the boring machine. The first hydraulic circuit powers the first and second hydraulic motors 32 and 52, while the second hydraulic circuit powers the third and fourth motors 62 and 72. The two hydraulic circuits are independent.

The operation of the first embodiment of FIG. 9 when the boring machine is in service is described below with reference to the first hydraulic circuit.

When putting the boring machine into service, the first main hydraulic pump 112 preferably delivers at its maximum. The first main hydraulic motor 116, which drives the first and second secondary hydraulic pumps 118 and 120 is thus at its maximum speed of rotation. The cylinder capacity of the two secondary hydraulic pumps 118 and 120 is at zero. There is thus no flow in the closed circuits, which are full, and the hydraulic motors do not rotate. In order to make one of the motors rotate, it is necessary to change the cylinder capacity of the associated secondary hydraulic pump.

By way of example, in order to have the same speed of rotation for the first and second hydraulic motors 32 and 52, the cylinder capacities of the first and second secondary hydraulic pumps both follow the same setpoint. In order to make a motor rotate in reverse, the direction in which the secondary hydraulic pump of the circuit in question is driven is reversed. It is thus possible to control the first and second motors 32 and 52 to rotate forwards and backwards independently of each other and at the desired speed of rotation. For example, power may be transferred to the motor requiring the most pressure. The second hydraulic circuit operates in the same manner, independently of the first hydraulic circuit, thereby also making it possible for the third and fourth hydraulic motors 62 and 72 to be controlled independently of each other and likewise independently of the first and second hydraulic motors.

Figure 10:
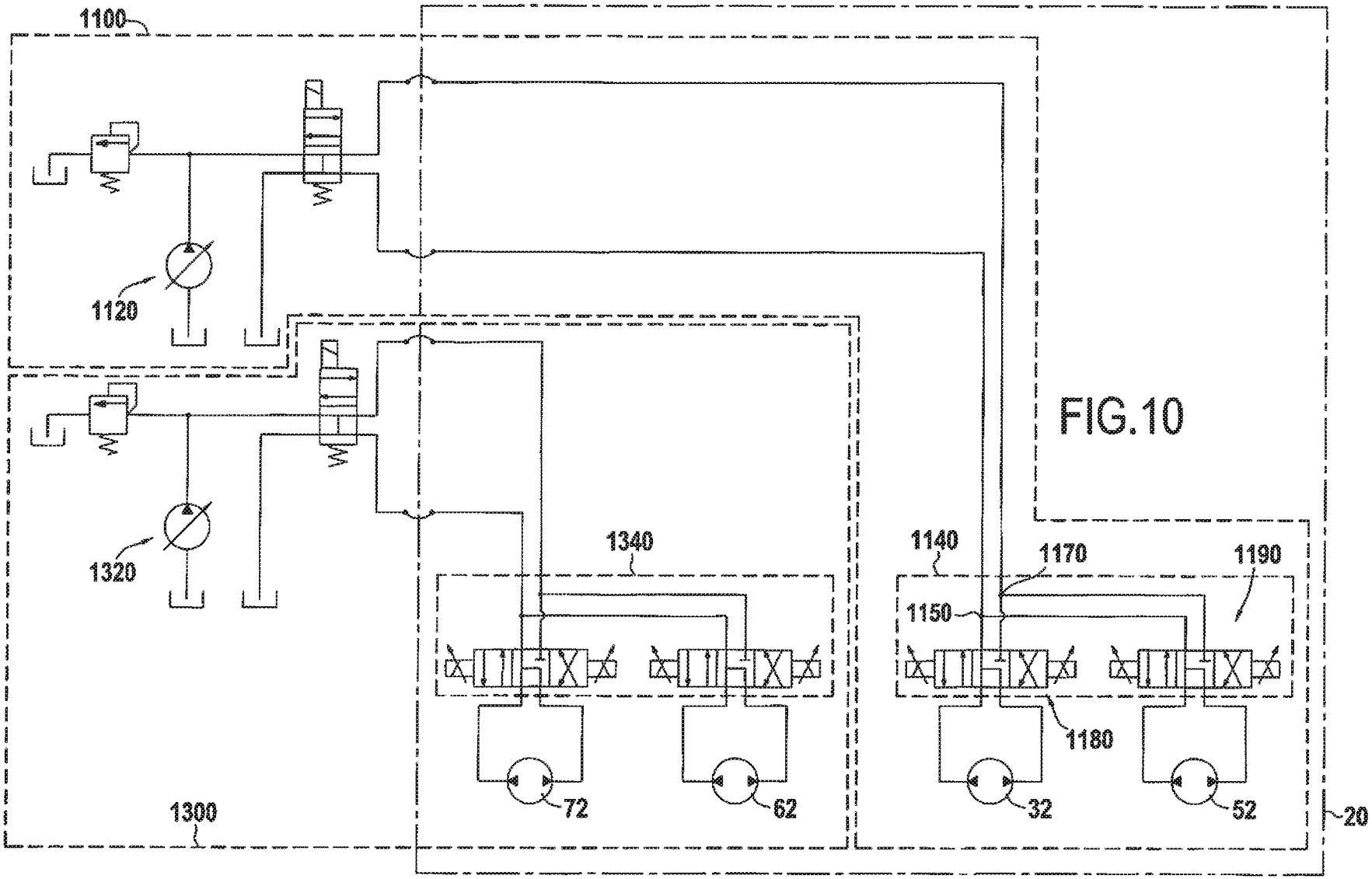
FIG. 10 shows a second embodiment of a hydraulic circuit for controlling the boring device of the FIG. 1 machine.

FIG. 10 shows a second embodiment of the first and second hydraulic circuits 1100 and 1300. The first hydraulic circuit 1100 comprises:

a first main hydraulic pump 1120; and a first distribution member 1140 that comprises a first hydraulic junction 1150 that is connected to the first main hydraulic pump 1120 and to the first hydraulic motor 32, and a second hydraulic junction 1170 that is connected to the first main hydraulic pump 1120 and to the second hydraulic motor 52.

Once more, in this second embodiment, the boring device includes the first distribution member.

The first hydraulic circuit also comprises a first proportional valve 1180 that is arranged between the first distribution member 1140 and the first hydraulic motor 32, and a second proportional valve 1190 that is arranged between the second hydraulic motor 52 and the first distribution member 1140. The distribution of flows between the first and second hydraulic motors is controlled by the two proportional valves 1180 and 1190. The function of each proportional valve is to control the speed and the direction of rotation of its hydraulic motor. It can take all of the flow from the main hydraulic pump 1120. The second hydraulic circuit 1300 powering the third and fourth motors 62 and 72 is identical to the first circuit 1100. The second hydraulic circuit comprises:

a second main hydraulic pump 1320; and a second distribution member 1340 connected to the second main hydraulic pump 1320, the second distribution member 1340 powering a second group of two motors constituted by the third and fourth motors 62 and 72. This second group is different from the first group and the boring device 20 includes the second distribution member 1340.

Figure 11:
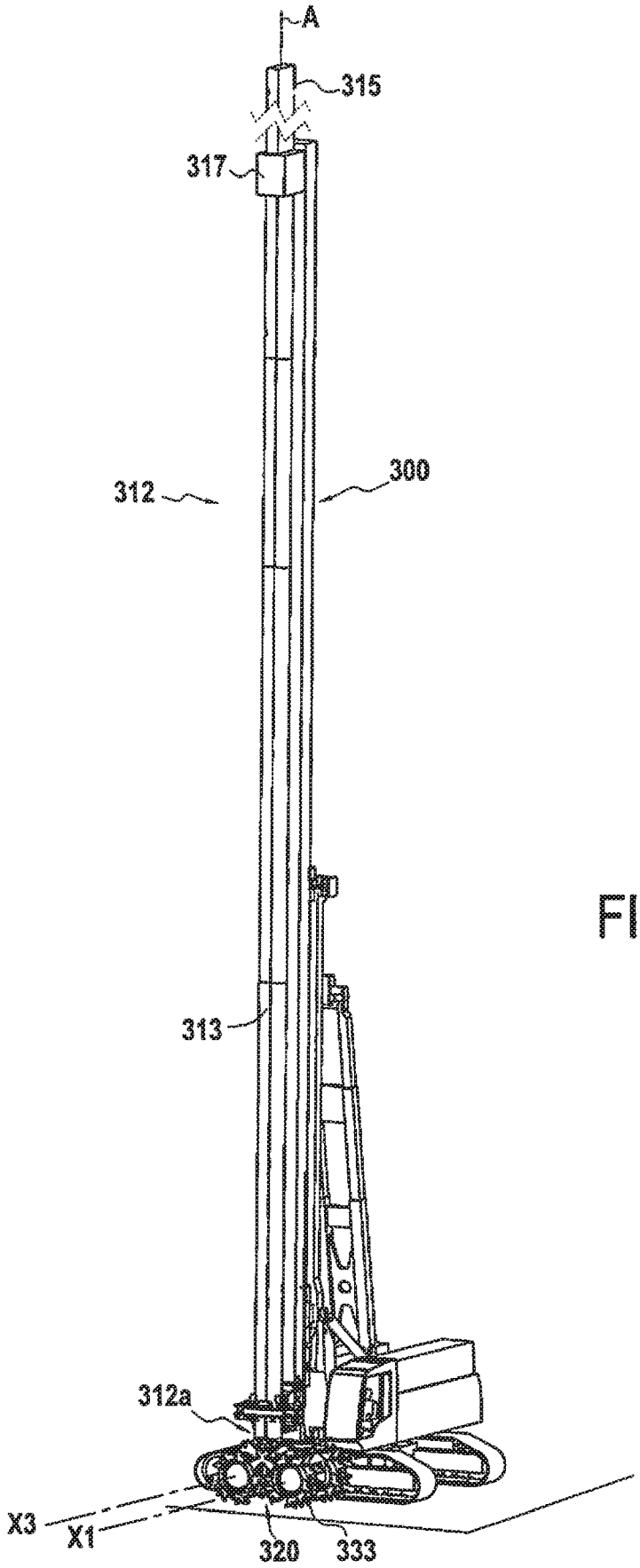
FIG. 11 shows another example of a boring machine of the disclosure, that has the ability to mix the excavated soil with a binder.

FIG. 11 shows a boring machine of the disclosure, which is both a boring machine and a mixing machine 300. The boring and mixing machine 300 has a frame 312 constituted by a longitudinal bar 313 commonly referred to as a "Kelly". The machine 300 also has a mast 315 and a carriage 317 that is movable along the mast, the carriage being fastened to the longitudinal bar so as to move the longitudinal bar. The machine 300 also has a boring device 320 carried by the bottom end 312*a* of the longitudinal bar. The boring device 320 is similar to the boring device 20 described above except that the cutter teeth are cutter and mixer blades for cutting and mixing soil. Such blades are known from elsewhere and they are not described in greater detail herein.

The invention claimed is:

1. A boring machine for making a trench in soil, the boring machine comprising a frame extending along a longitudinal direction, said frame having a bottom end, the boring machine having a boring device mounted at the bottom end of the frame, the boring device comprising:

a first boring member that is rotatable about a first axis of rotation, the first axis of rotation being transverse to the longitudinal direction of the frame;

a first motor configured to drive rotation of the first boring member about the first axis of rotation;

a second boring member rotatable about a second axis of rotation, the second axis of rotation being stationary relative to the first axis of rotation;

a second motor configured to drive the second boring member in rotation about the second axis of rotation;

a third boring member rotatable about a third axis of rotation, the third axis of rotation being spaced apart from and parallel to the first axis of rotation;

a third motor configured to drive the third boring member in rotation about the third axis of rotation;

a fourth boring member that is rotatable about a fourth axis of rotation, the fourth axis of rotation being stationary relative to the first, second, and third axes of rotation, the first and third axes of rotation lying in a first plane that is stationary relative to a second plane containing the second and fourth axes of rotation; and a fourth motor configured to drive the fourth boring member in rotation about the fourth axis of rotation;

wherein the boring machine further comprises a control member configured to control the first, second, third, and fourth motors independently of one another, the first, second, third, and fourth motors are hydraulic, and the control member is configured to adjust the hydraulic power delivered to each of the first, second, third, and fourth motors.

2. The boring machine according to claim 1, wherein the second boring member is suitable for rotating relative to the first boring member.

3. The boring machine according to claim 1, wherein the fourth boring member is suitable for rotating relative to the third boring member.

4. The boring machine according to claim 1, wherein the boring device includes a support that is mounted at the bottom end of the frame and that carries the first, second, third, and fourth boring members, together with the first, second, third, and fourth motors.

5. The boring machine according to claim 4, wherein the support comprises a plate to which the first, second, third, and fourth boring members and the first, second, third, and fourth motors are mounted.

6. The boring machine according to claim 1, wherein the first, second, third, and fourth axes of rotation lie substantially in a common plane that is transverse to the longitudinal direction of the frame.

7. The boring machine according to claim 1, wherein the first, second, third, and fourth motors are housed respectively in the first, second, third, and fourth boring members.

8. The boring machine according to claim 1, wherein the first, second, third, and fourth boring members comprise respectively first, second, third, and fourth pairs of drums, the first, second, third, and fourth pairs of drums being provided respectively with first, second, third, and fourth series of cutter teeth.

9. The boring machine according to claim 1, wherein the first and second axes of rotation are colinear, and the third and fourth axes of rotation are colinear.

10. The boring machine according to claim 1, wherein the diameters of the second and fourth boring members are greater than the diameters of the first and third boring members.

11. The boring machine according to claim 10, wherein the distance between the second and fourth axes of rotation is greater than the distance between the first and third axes of rotation.

12. The boring machine according to claim 10, wherein the first, second, third, and fourth boring members comprise respectively first, second, third, and fourth pairs of drums, the first, second, third, and fourth pairs of drums being provided respectively with first, second, third, and fourth series of cutter teeth, and wherein the radial heights of the cutter teeth of the second and fourth series of teeth are greater than the radial heights of the cutter teeth of the first and third series of teeth.

13. The boring machine according to claim 1, wherein the first boring member comprises first and second drums and the second boring member comprises third and fourth drums, and wherein the minimum distance between the second and third drums considered in a direction parallel to the first axis of rotation is less than 5 cm.

14. The boring machine according to claim 1, wherein the control member is configured to control the speeds of rotation and/or the directions of rotation of the first, second, third, and fourth motors independently of one another.

15. The boring machine according to claim 1, wherein the boring machine further comprises at least a first hydraulic circuit, the first hydraulic circuit comprising:

a first main hydraulic pump; and a first distribution member connected to the first main hydraulic pump, the first distribution member powering a first group of two motors selected from the first, second, third, and fourth motors.

16. The boring machine according to claim 15, wherein the boring device includes the first distribution member.

17. The boring machine according to claim 15, wherein the first distribution member comprises:

a first main hydraulic motor powered by the first main hydraulic pump;

a first secondary hydraulic pump actuated by said first main hydraulic motor, the first secondary hydraulic pump powering one of the two motors of the first group; and a second secondary hydraulic pump actuated by said first main hydraulic motor, the second secondary hydraulic pump powering the other one of the two motors of the first group.

18. The boring machine according to claim 15, wherein the first distribution member comprises a first hydraulic junction connected to the first main hydraulic pump and to at least one of the motors of the first group, and a second hydraulic junction connected to the first main hydraulic pump and to at least the other one of the motors of the first group.

19. The boring machine according to claim 15, wherein the boring machine further comprises a second hydraulic circuit comprising:

a second main hydraulic pump; and a second distribution member connected to the second main hydraulic pump, the second distribution member powering a second group of two motors taken from among the first, second, third, and fourth motors, the second group being different from the first group.

20. The boring machine according to claim 19, wherein the boring device includes the second distribution member.

21. The boring machine according to claim 1, wherein said boring machine is a cutter, and wherein the first, second, third, and fourth boring members have cutter teeth.

22. The boring machine according to claim 1, wherein said boring machine is a boring and mixing machine, and wherein the first, second, third, and fourth boring members comprise mixing tools.

23. The boring machine according to claim 22, wherein the frame is constituted by a longitudinal bar, and wherein said machine further comprises a mast and a carriage that is movable along the mast, the carriage being fastened to the longitudinal bar.

24. A method of making a diaphragm wall in soil by using a boring machine, the boring machine comprising a frame extending along a longitudinal direction, said frame having a bottom end, the boring machine having a boring device mounted at the bottom end of the frame, the method comprising:

providing a first boring member of the boring device that is rotatable about a first axis of rotation, the first axis of rotation being transverse to the longitudinal direction of the frame;

driving rotation of the first boring member about the first axis of rotation using a first motor of the boring device, the first motor being hydraulic;

providing a second boring member of the boring device rotatable about a second axis of rotation, the second axis of rotation being stationary relative to the first axis of rotation;

driving the second boring member in rotation about the second axis of rotation using a second motor of the boring device, the second motor being hydraulic;

providing a third boring member of the boring device rotatable about a third axis of rotation, the third axis of rotation being spaced apart from and parallel to the first axis of rotation;

driving the third boring member in rotation about the third axis of rotation using a third motor of the boring device, the third motor being hydraulic;

providing a fourth boring member of the boring device that is rotatable about a fourth axis of rotation, the fourth axis of rotation being stationary relative to the first, second, and third axes of rotation, the first and third axes of rotation lying in a first plane that is stationary relative to a second plane containing the second and fourth axes of rotation;

driving the fourth boring member in rotation about the fourth axis of rotation using a fourth motor of the boring device, the fourth motor being hydraulic;

controlling the first, second, third, and fourth motors independently of one another;

adjusting the hydraulic power delivered to each of the first, second, third, and fourth motors;

excavating the soil with the boring machine so as to make a trench; and forming a diaphragm wall in said trench.

25. The method of making a diaphragm wall according to claim 24, wherein the diameters of the second and fourth boring members are greater than the diameters of the first and third boring members, and wherein the diaphragm wall is circular.

26. A boring machine for making a trench in soil, the boring machine comprising a frame extending along a longitudinal direction, said frame having a bottom end, the boring machine having a boring device mounted at the bottom end of the frame, the boring device comprising:

a first boring member that is rotatable about a first axis of rotation, the first axis of rotation being transverse to the longitudinal direction of the frame, the first boring member comprising first and second drums;

a first motor configured to drive rotation of the first boring member about the first axis of rotation;

a second boring member rotatable about a second axis of rotation, the second axis of rotation being stationary relative to the first axis of rotation, the second boring member comprising third and fourth drums;

a second motor configured to drive the second boring member in rotation about the second axis of rotation;

a third boring member rotatable about a third axis of rotation, the third axis of rotation being spaced apart from and parallel to the first axis of rotation;

a third motor configured to drive the third boring member in rotation about the third axis of rotation;

a fourth boring member that is rotatable about a fourth axis of rotation, the fourth axis of rotation being stationary relative to the first, second, and third axes of rotation, the first and third axes of rotation lying in a first plane that is stationary relative to a second plane containing the second and fourth axes of rotation; and a fourth motor configured to drive the fourth boring member in rotation about the fourth axis of rotation, wherein the minimum distance between the second and third drums considered in a direction parallel to the first axis of rotation is less than 5 cm.

* * * * *